United States Patent [19]

Taya

[11] Patent Number: 5,026,523

[45] Date of Patent: Jun. 25, 1991

[54] PROCESS FOR INHIBITING CORROSION OF VAPOR/CONDENSED WATER SYSTEM

[75] Inventor: Shiro Taya, Tokyo, Japan

[73] Assignee: Kurita Water Industries Ltd., Tokyo, Japan

[21] Appl. No.: 469,061

[22] Filed: Jan. 23, 1990

[30] Foreign Application Priority Data

Feb. 9, 1989 [JP] Japan ..... 1-30195

[51] Int. Cl.[5] ..... C23F 11/04

[52] U.S. Cl. ..... 422/16; 252/8.555; 252/392; 252/403

[58] Field of Search ..... 422/16; 252/8.555, 392, 252/403

[56] References Cited

U.S. PATENT DOCUMENTS 3,152,187 10/1964 Coyne et al. .
3,976,441 8/1976 Bialy et al. .
4,206,172 6/1980 Sujdak ..... 422/9

FOREIGN PATENT DOCUMENTS 56-8495 1/1981 Japan .
62-205292 9/1987 Japan .

OTHER PUBLICATIONS

CA94(20): 159,573b, Abstract of JP56-008,495, Jan. 28, 1981.
CA108(12): 90071g, Abstract of JP62-205,292, Sep. 9, 1987.

*Primary Examiner*—Robert J. Warden
*Assistant Examiner*—Timothy M. McMahon
*Attorney, Agent, or Firm*—Kanesaka and Takeuchi

[57] ABSTRACT

An anticorrosive for vapor/condensed water systems, which comprises at least one aminodiol represented by the following general formula:

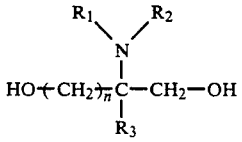

(in which $R_1$, $R_2$ and $R_3$ each represents —H, —$CH_3$, —$C_2H_5$ or $C_3H_7$; and n represents an integer of 0 to 2) and the process for inhibiting the corrosion of vapor/-condensed water systems, which comprises at least one aminodiol as mentioned above to a boiler feed water at the concentration of 0.1 to 500 mg/l. The aminodiol, when added to feed water, migrates into condensed water in large quantities and inhibits the corrosion of piping systems and boilers in highly effective manner.

7 Claims, No Drawings

PROCESS FOR INHIBITING CORROSION OF VAPOR/CONDENSED WATER SYSTEM

FIELD OF THE INVENTION AND RELATED ART STATEMENT

The present invention relates to an anticorrosive or a corrosion inhibitor for vapor/condensed water systems. In particular, it relates to an anticorrosive which is capable of effectively inhibitinq the corrosion of piping systems by changing $CO_2$, which is contained in condensed water and causes the corrosion of piping systems, into an amine carbonate.

In general, soft water is used as a feed for low pressure boilers of up to ca. 20 kg/cm$^2$. However, when boilers are fed with soft water, $CO_2$ is formed through the thermal decomposition of methyl orange alkalinity components (M alkalinity components) contained in the feed water, and the $CO_2$ so formed dissolves into condensed water, thus causing the corrosion of the piping systems.

As anticorrosives for vapor/condensed water systems, there have hitherto been employed highly volatile amines, such as cyclohexylamine and morpholine. In general, such agents are injected into a water-feeding system and circulated through a boiler. Prior anticorrosives consisting of highly volatile amines come to be distributed more in vapor than in condensed water at the time when vapor generated by a boiler is condensed.

If the volatility of amines contained in vapor is low, there will be formed a condensed water containing the amines in large quantities, whereas highly volatile amines contained in vapor can dissolve into condensed water only in extremely small quantities. Accordingly, prior anticorrosives consisting of highly volatile amines suffer from the problem that they are incapable of removing $CO_2$ dissolved in condensed water to a sufficient degree because of their low solubility in condensed water.

OBJECTS AND SUMMARY OF THE INVENTION

It is an object of the present invention to provide an anticorrosive for vapor/condensed water systems, which is free from the above problems and capable of effectively inhibiting the corrosion of piping systems by changing $CO_2$, which is contained in condensed water and causes the corrosion of piping systems, into an amine carbonate.

It is another object of the present invention to provide an anticorrosive for vapor/condensed water systems, which can dissolve in feed water at a high concentration, is capable of readily raising the pH of feed water to a satisfactory high level and, hence, can be highly effective with regard to the prevention of the corrosion of boilers.

It is a further object of the invention to provide a process for inhibiting the corrosion of vapor/condensed water systems using an anticorrosive as mentioned above.

These and other objects of the invention can be achieved by an anticorrosive which comprises at least one aminodiol represented by General Formula (I) of the following:

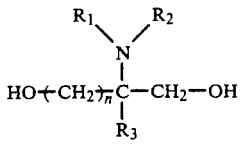

(I)

(wherein $R_1$, $R_2$ and $R_3$ each represents —H, —$CH_3$, —$C_2H_5$ or —$C_3H_7$; and n represents an integer of 0 to 2).

The aminodiols represented by General Formula (I) are low volatile amines volatility of which is low enough to allow the compounds to dissolve or migrate into condensed water in large quantities to effectively change $CO_2$ contained in the condensed water to amine carbonates.

Since the volatility of the asinodiols according to the invention is low, the compounds, when added to feed water, possess only a relatively low capability of migrating from the feed water into vapor. However, the compounds can be dissolved in feed water at high concentrations and, in addition, possess a markedly high capability of migrating from vapor into condensed water. As a result, the compounds come to be dissolved in condensed water in quantities which are large enough to allow them to function as an anticorrosive in an extremely effective manner.

There is also provided by the present invention a process for inhibiting the corrosion of vapor/condensed water systems, which comprises adding an anticorrosive comprising at least one aminodiol represented by the above General Formula (I) to feed water at a concentration of 0.1 to 500 mg/l.

DESCRIPTION OF THE PREFERRED EMBODIMENTS

The present invention will hereinafter be explained in further detail.

Among aminodiols to be used in the anticorrosive according to the present invention, those having a low volatility can be particularly preferable.

As specific examples of aminodiols represented by General Formula (I), mention may be made of 1-amino-1,2-ethanediol, 2dimethylamino-1,4-butanediol, 2-amino-2-ethyl-1,3-propanediol, 2-diethylamino-2-propyl-1,3-propanediol, 2-amino-2-ethyl-1,4-butanediol and the like.

There is no particular restriction on the content of the aminodiols to be contained in the anticorrosive according to the present invention. The concentration of the compounds can be selected within the range of from 1 to 100% by weight.

The anticorrosive according to the invention may contain other volatile amines in combination with aminodiols represented by General Formula (I). As examples of such volatile amines usable in combination with the aminodiols, mention may be made of cyclohexylamine, ammonia, aminomethylpropanol, morpholine, and aminoalcohols represented by General Formula (II) of the following:

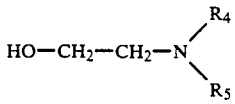

(II)

(in which $R_4$ and $R_5$ each represents —H, —$CH_3$, —$C_2H_5$ or $C_3H_7$).

As specific examples of aminoalcohols represented by General Formula (II), mention may be made of monoethanolamine, N,N-dimethylmonoethanolamine, N,N-diethylmonoethanolamine, N-propylmonoethanolamine and the like.

It is possible to attain further improved anticorrosive effects by using the aminodiols represented by General Formula (I) in combination with other volatile amines, such as aminoalcohols represented by General Formula (II).

There is no particular restriction on the total amount of the aminodiols and other volatile amines to be contained in the anticorrosive according to the invention. It can be selected within the range of from 1 to 100% by weight.

There is no particular restriction on the ratio of the aminodiols to other volatile amines. The ratio can be selected within the following range (based on weight): [Aminodiols]: [Other volatile amines]=1:99 to 99:1.

In such a case, the aminodiols and other volatile amines can be in the form of a mixture prepared by admixing them at a predetermined ratio prior to their use, or can be separately injected into systems to be protected with them.

In addition to the aminodiols and other volatile amines, the anticorrosive according to the present invention can be additionally incorporated with other additives, such as other anticorrosives, modifiers and the like.

In the process of the present invention for inhibiting the corrosion of vapor/condensed water systems, an anticorrosive comprising at least one aminodiol represented by General Formula (I) is added to feed water of a boiler at a concentration of ca. 0.1 to 500 mg, per liter of feed water, if desired, in combination with other volatile amines and other additives.

The anticorrosive of the present invention can be highly effective for the inhibition of corrosion in vapor/condensed water systems having a condensation rate of 0 to 100%, for example, in boiler plant vapor/condensed water systems. The anticorrosive of the present invention can inhibit the corrosion of piping systems since it possesses an extremely high solubility in condensed water and, hence, can effectively change $CO_2$, which is contained in condensed water and causes the corrosion of piping systems, into an amine carbonate. The anticorrosive can also be highly effective with regard to the inhibition of corrosion of boilers per se since its solubility in feed water for boilers is quite high and, hence, the pH of the feed water can be readily raised.

The present invention will further be explained by way of examples.

EXAMPLE 1

A vapor-generating autoclave was operated at 180° C., during which a test water (soft water) having the quality set forth below and added (except the case of Run No. 1) with various agents shown in Table 1 at a concentration of 15 mg, per liter of feed water, was fed at a rate of 12 to 12.8 l/hr. The vapor so generated was fed to a condenser, and a test piece of mild steel (15×50×1 mm) was immersed in the condensed water. The rate of corrosion was measured after 48 hours. The blow rate was set at 10%.

Results obtained are shown in Table 1.

Quality of Test Water

Softened water from the Atsugi City Water Supply Service pH: 8.1

Electric conductivity: 200 μs/cm

M alkalinity: 45 mg-$CaCO_3$/l

Cl: 13 mg/l $SiO_2$: 29 mg/l $SO_4^{2-}$: 25 mg/l

TABLE 1

| Run No. | Agents Kind | Agents Content (Wt %) | Corrosion Rate (mdd) | Notes |
|---|---|---|---|---|
| 1 | — | — | 17.2 | *1 |
| 2 | Cyclohexylamine | 100 | 7.2 | *1 |
| 3 | Morpholine | 100 | 6.2 | *1 |
| 4 | Monoethanolamine | 100 | 4.8 | *1 |
| 5 | 2-Amino-2-ethyl-1,3-propanediol | 100 | 3.2 | *2 |
| 6 | 2-Amino-2-ethyl-1,3-propanediol | 50 | 2.5 | *2 |
| | Monoethanolamine | 50 | | |
| 7 | 2-Amino-2-ethyl-1,3-propanediol | 50 | 2.8 | *2 |
| | Cyclohexylamine | 50 | | |
| 8 | 2-Amino-2-methyl-1,3-propanediol | 100 | 3.3 | *2 |
| 9 | 2-Amino-2-methyl-1,3-propanediol | 50 | 2.4 | *2 |
| | Monoethanolamine | 50 | | |

*1: Control examples for comparison
*2: Examples according to the present invention It would be apparent from Table 1 that the anticorrosives according to the present invention exhibit excellent anticorrosive effects.

EXPERIMENTAL EXAMPLE 1

The autoclave used in Example 1 was operated under the same conditions, and the distribution of the agents shown in Table 2 was examined at a condensation rate of 10%.

Results obtained are shown in Table 2.

TABLE 2

| No. | Agents | Concentration in Boiler Water (mg/l) | Concentration in Vapor (mg/l) | Concentration in Condensed Water (mg/l) |
|---|---|---|---|---|
| 1 | Cyclohexylamine | 12 | 15 | 5.0 |
| 2 | Morpholine | 26.5 | 14 | 15.0 |
| 3 | Monoethanolamine | 107 | 7 | 38.9 |
| 4 | 2-Amino-2-ethyl-1,3-propanediol | 172 | 5 | 23.4 |

It would be understood from the results shown in Table 2 that 2-amino-2-ethyl-l,3-propanediol is inferior in its capability of migrating into vapor but is excellent in its overall capability of migrating into condensed water.

What is claimed is:

1. A process for inhibiting corrosion of vapor/condensed water systems, which comprises adding to boiler feed water an anticorrosive comprising at least one aminodiol represented by General formula (I) of the following:

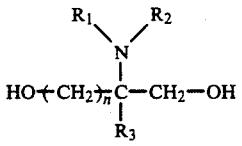

(I)

(in which $R_1$, $R_2$ and $R_3$ each represents —H, —$CH_3$, —$C_2H_5$ or —$C_3H_7$; and n represents an integer of 0 to 2) in an amount of 0.1 to 500 mg per liter of said boiler feed water so that the aminodiol is contained in vapor and condensed water and changes $CO_2$ contained in the vapor and condensed water to an amine carbonate.

2. A process as defined in claim 1, wherein other volatile amines are additionally added to said boiler feed water in combination with said aminodiols.

3. A process as defined in claim 1, wherein said aminodiol is a member selected from the group consisting of 1-amino-l,2-ethanediol, 2-dimethylamino-l,4-butanediol, 2-amino-2-ethyl-l,3-propanediol, 2-diethylamino-2-propyl-l,3-propanediol and 2-amino-2-ethyl-l,4-butanediol.

4. A process as defined in claim 1, wherein the content of said aminodiols in said anticorrosive is in the range of from 1 to 100% by weight.

5. A process as defined in claim 2, wherein said other volatile amines are one or more aminoalcohols represented by General Formula (II) of the following:

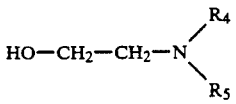

(II)

(in which $R_4$ and $R_5$ each represents —H, —$CH_3$, —$C_2H_5$ or —$C_3H_7$).

6. A process as defined in claim 5, wherein said aminoalcohol is a member selected from the group consisting of monoethanolamine, N,N-dimethylmonoethanolamine, N,N-diethylmonoethanolamine and N-propylmonoethanolamine.

7. A process as defined in claim 2, wherein the ratio of said aminodiols to said other volatile amines is in the range of 1/99 to 99/1, based on weight.

* * * * *